US010513041B2

(12) United States Patent
Greene

(10) Patent No.: US 10,513,041 B2
(45) Date of Patent: Dec. 24, 2019

(54) SHAVING APPARATUS

(71) Applicant: HeadBlade, Inc., Gardena, CA (US)

(72) Inventor: Todd Greene, Santa Monica, CA (US)

(73) Assignee: Headblade, Inc., Gardena, CA (US)

( * ) Notice: Subject to any disclaimer, the term of this patent is extended or adjusted under 35 U.S.C. 154(b) by 107 days.

(21) Appl. No.: 15/794,767

(22) Filed: Oct. 26, 2017

(65) Prior Publication Data

US 2019/0126503 A1 May 2, 2019

(51) Int. Cl.

| | |
|---|---|
| ***B26B 21/52*** | (2006.01) |
| ***B26B 21/22*** | (2006.01) |
| ***B26B 21/40*** | (2006.01) |

(52) U.S. Cl.

CPC ..... *B26B 21/522* (2013.01); *B26B 21/225* (2013.01); *B26B 21/4012* (2013.01); *B26B 21/521* (2013.01); *B26B 21/527* (2013.01)

(58) Field of Classification Search

CPC ... B26B 21/522; B26B 21/521; B26B 21/225; B26B 21/527

USPC ..... 30/526

See application file for complete search history.

(56) References Cited

U.S. PATENT DOCUMENTS 5,167,069 A * 12/1992 Quinn ..... B26B 21/523 30/527
5,560,106 A * 10/1996 Armbruster ..... B26B 21/225 30/526
6,018,877 A 2/2000 Greene
D426,918 S 6/2000 Greene
6,112,421 A 9/2000 Greene
D446,351 S 8/2001 Greene
D500,889 S 1/2005 Greene
7,140,115 B2 * 11/2006 Greene ..... B26B 21/40 30/526
7,200,938 B2 4/2007 Lembke
8,782,911 B1 * 7/2014 Greene ..... B26B 21/52 30/298
9,522,472 B2 * 12/2016 Leicht ..... B26B 21/4075
9,687,989 B2 * 6/2017 Robertson ..... B26B 21/521
(Continued)

OTHER PUBLICATIONS

YouTube Video "Headblade Moto Headshaver Review" (Sly Bald Guys) Nov. 20, 2016; URL: <<https://www.youtube.com/watch?v=pWVw5PQabio>>.

(Continued)

*Primary Examiner* — Ghassem Alie
*Assistant Examiner* — Bharat C Patel
(74) *Attorney, Agent, or Firm* — Pierce Atwood LLP; Kevin M. Farrell; Shannon Vittengl

(57) ABSTRACT

A shaving apparatus having a body including a central lumen and one or more rolling elements are rotatingly attached to the bottom surface of the shaving apparatus. The apparatus includes a shaving head assembly rotatably attachable within the central lumen. The shaving head assembly includes one or more shaving blades and a blade cartridge attachment arm for attachment of the blade cartridge to a mounting shaft having a bearing surface. The shaving head assembly, or a subunit thereof, rotates about an axis of rotation defined by the major axis of the mounting shaft. One or more engagement elements removably retain the shaving head assembly within the central lumen, and a mechanical release mechanism which includes an actuator, is provided to remove the shaving head assembly.

25 Claims, 8 Drawing Sheets

(56) References Cited

U.S. PATENT DOCUMENTS

| | | | | |
|---|---|---|---|---|
| 9,764,487 | B2 * | 9/2017 | Robertson | B26B 21/521 |
| 9,849,599 | B2 * | 12/2017 | Gers-Barlag | B26B 21/4081 |
| 2004/0177519 | A1 * | 9/2004 | Tomassetti | B26B 21/225 30/527 |
| 2005/0246906 | A1 | 11/2005 | Greene | |
| 2012/0246947 | A1 | 10/2012 | Fang et al. | |
| 2013/0291391 | A1 * | 11/2013 | Stevens | B26B 21/52 30/530 |
| 2014/0033551 | A1 * | 2/2014 | Szczepanowski | B26B 21/521 30/527 |
| 2015/0290822 | A1 * | 10/2015 | Haba | B26B 21/225 30/526 |
| 2015/0306777 | A1 | 10/2015 | Georgakis et al. | |
| 2016/0136826 | A1 | 5/2016 | Gers-Barlag et al. | |
| 2017/0043492 | A1 | 2/2017 | Robertson et al. | |
| 2017/0312928 | A1 | 11/2017 | Greene | |

OTHER PUBLICATIONS

FaceBook Post "We've had questions about the S4 MOTO Industrial" Headblade, Dec. 14, 2016; URL: <<https://www.facebook.com/headblade/posts/10154849757723464?_xts_%5B0%5D=68.

* cited by examiner

SHAVING APPARATUS

BACKGROUND OF THE INVENTION

A number of different shaving devices are available, the vast majority of which are primarily designed for shaving a man's face, a woman's legs or other portions of the human torso. In fact, a single design often has been used for shaving many different body areas. The most common multi-purpose designs utilize a substantially straight handle shaped to be grasped by one hand. In these devices, the handle curves or otherwise transitions into a head portion of the device where the razor blade is mounted. The long axis of the razor blades are oriented at right angles to the long axis of the handle, which generally facilitates a straight shaving stroke.

The angle the cutting edge of the blade(s) makes with the surface to be shaved is critical. This "cutting angle" is the angle formed between the surface and the plane of the blade with the actual cutting edge in contact with the surface forming the apex of the angle. For effective shaving, the cutting angle should be a relatively small acute angle. In traditional razor systems, if the relationship between the blade and handle is fixed, the plane of the blade approaches being parallel to the long axis of the handle. As such, when the razor is stroked along a surface to be shaved the cutting angle is "automatically" an effective acute angle. In modern "straight handle" razor systems, the blade(s) is held at a predetermined angle in a replaceable cartridge that frames the blade(s). The cartridge, in turn, is mounted on some type of mechanical swivel so the when the cartridge is brought into contact with the surface to be shave, the entire assembly pivots to ensure an optimal cutting angle.

Shaving device designs other than the simple "straight handle razor" are available. For example, U.S. Pat. Nos. D426,918; D446,351; D500,889; D667,168; 6,112,421; 6,018,877; 7,140,115; and 8,782,911, each of which were issued to the present inventor, describe and illustrate different designs that utilize a short body and a hook, either open or closed (e.g. a ring) along the top surface of the device, for engaging a user's finger to assist in manipulating the shaver. The foregoing patents are incorporated by reference herein in their entirety.

The shaver designs disclosed in the foregoing patents have particular applicability to, shaving one's head. However, the present inventor has discovered that additional improvements can be made to provide better results and to enhance the versatility of such shavers.

SUMMARY OF THE INVENTION

According to one aspect of the invention, shaving apparatus are provided, including: a body that includes: i) a bottom surface, a top surface, a front portion, a back portion and a central lumen forming a lumen opening at the back portion of the apparatus, the central lumen having a bearing surface; ii) one or more rolling elements rotatingly attached to the bottom surface, near the front portion of the apparatus; iii) a shaving head assembly rotatably attachable within the central lumen of the body, the shaving head assembly including: i) one or more shaving blades mounted within a blade cartridge, the one or more shaving blades having a major orientation axis; ii) a blade cartridge attachment arm for attachment of the blade cartridge to a mounting shaft having a bearing surface; wherein the shaving head assembly, or a subunit thereof, rotates about an axis of rotation defined by the major axis of the mounting shaft. In some embodiments, the mounting shaft is a rotating mounting shaft. In certain embodiments, a plurality of shaving blades are mounted within the blade cartridge and the blade cartridge is flexible about an axis generally parallel to the major orientation axis of the plurality of blades, and wherein axis of flexibility is between at least two shaving blades. In some embodiments, the shaving head assembly is rotatable between a neutral position and most extreme positive and most extreme negative non-neutral positions. In some embodiments, the range of rotation between the neutral position and the most extreme positive and negative non-neutral positions is less than 35 degrees in either direction. In some embodiments, the range of rotation between the neutral position and the most extreme positive and negative non-neutral positions is less than 25 degrees in either direction. In certain embodiments, the range of rotation between the neutral position and the most extreme positive and negative non-neutral positions is less than 10 degrees in either direction. In some embodiments, the range of rotation between the neutral and the most extreme positive and negative non-neutral position is limited by a mechanical detent. In certain embodiments, the mechanical detent comprises a raised element disposed on the bearing surface of the central lumen which engages a first fixed mechanical barrier on the rotating mounting shaft at the most extreme positive non-neutral position and engages a second fixed mechanical barrier at the most extreme negative non-neutral position. In some embodiments, the raised element comprises a fin and the first and second mechanical barriers comprise walls extending inward from the bearing surface of the rotating mounting shaft. In some embodiments, the mechanical detent comprises a raised element disposed on the bearing surface of the rotating mounting shaft which engages a first fixed mechanical barrier on the central lumen at the most extreme positive non-neutral position and engages a second fixed mechanical barrier on the central lumen at the most extreme negative non-neutral position. In certain embodiments, the raised element comprises a fin and the first and second mechanical barriers comprise walls extending outward from the bearing surface of the central lumen. In some embodiments, the rotating mounting shaft is, absent external forces, urged to neutral from any positive or negative non-neutral position through the action of a resilient pressure plate having a generally flat point of contact, with a generally flat portion of the rotating mounting shaft. In certain embodiments, the blade cartridge is rotatable about an axis generally parallel to the major orientation axis of the one or more shaving blades. In some embodiments, axis of rotation is defined by the connection between the blade cartridge and the blade cartridge attachment arm. In some embodiments, the blade cartridge rotates between a neutral position and a range of non-neutral positions, the range of rotation terminating at the most extreme non-neutral positon. In certain embodiments, the range of rotation between the neutral position and the most extreme non-neutral position is less than 60 degrees. In some embodiments, the range of rotation between the neutral position and the most extreme non-neutral position is less than 45 degrees. In some embodiments, the range of rotation between the neutral position and the most extreme non-neutral position is less than 30 degrees. In certain embodiments, the range of rotation between the neutral and the most extreme non-neutral position is limited by a resilient limiting finger on the blade cartridge attachment arm. In some embodiments, the resilient limiting finger tends to return the shaving head to the neutral position absent external forces. In some embodiments, the body further comprises a finger hook on the top surface. In certain embodiments, the finger hook is a split finger hook sized to accommodate a human finger running along the length of the upper surface of the body when in use. In some embodiments, the shaving head assembly is removably retained within the central lumen through the cooperation of one or more engagement elements of the mounting shaft with retaining elements located within the central lumen. In certain embodiments, the removal of the shaving head assembly is facilitated through a mechanical release mechanism which operates to interrupt the cooperative engagement between the one or more engagement elements of the mounting shaft with the retaining elements located within the central lumen.

BRIEF DESCRIPTION OF THE DRAWINGS

FIG. 7A shows the shaving apparatus centered on mounting shaft 36. FIGS. 7B & 7C show the shaving apparatus rotated in the direction of the respective arrow.

DETAILED DESCRIPTION OF PREFERRED EMBODIMENTS

Figure 1:
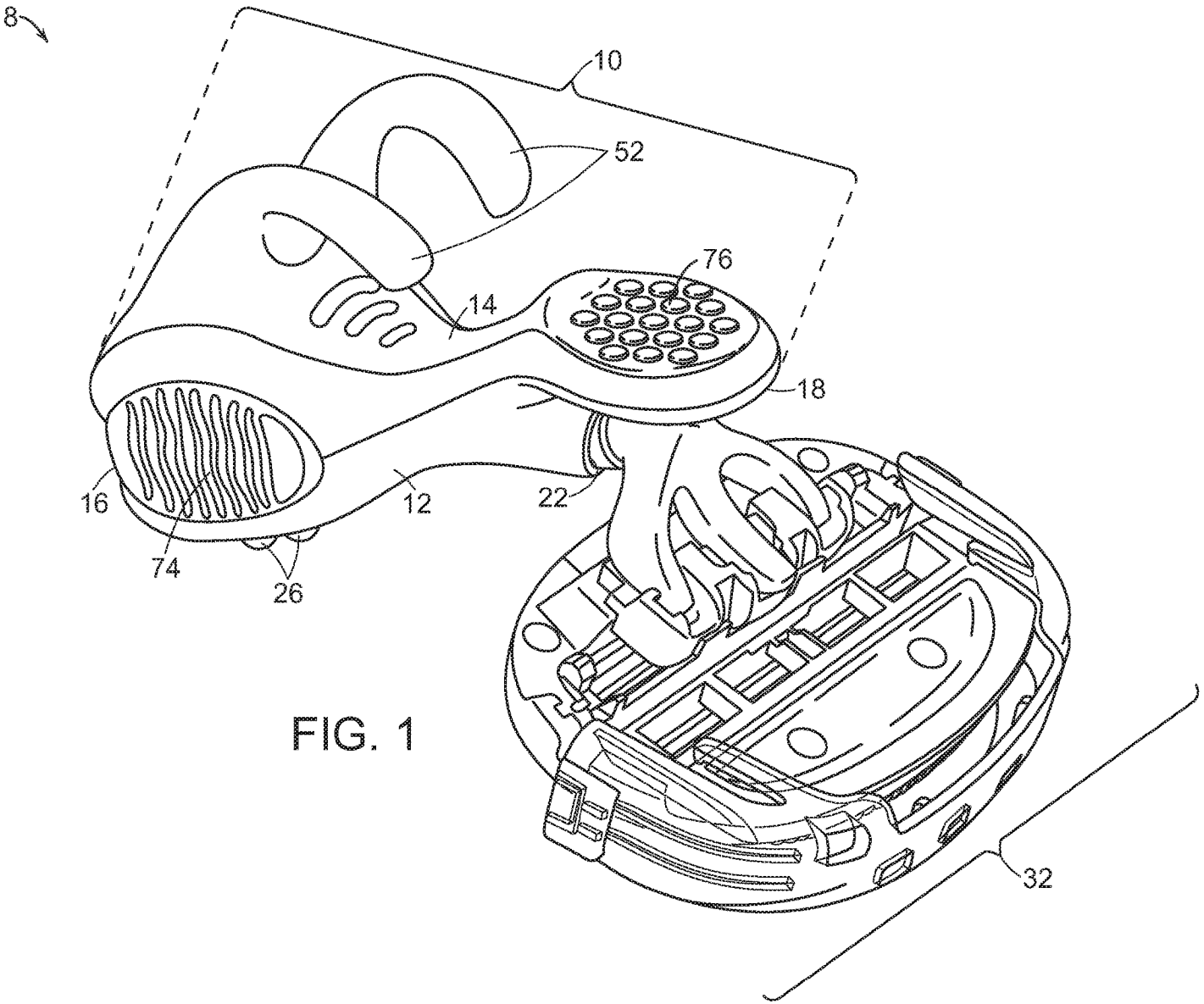
FIG. 1 illustrates a top perspective view of a shaving apparatus according to one embodiment of the invention.
Figure 2:
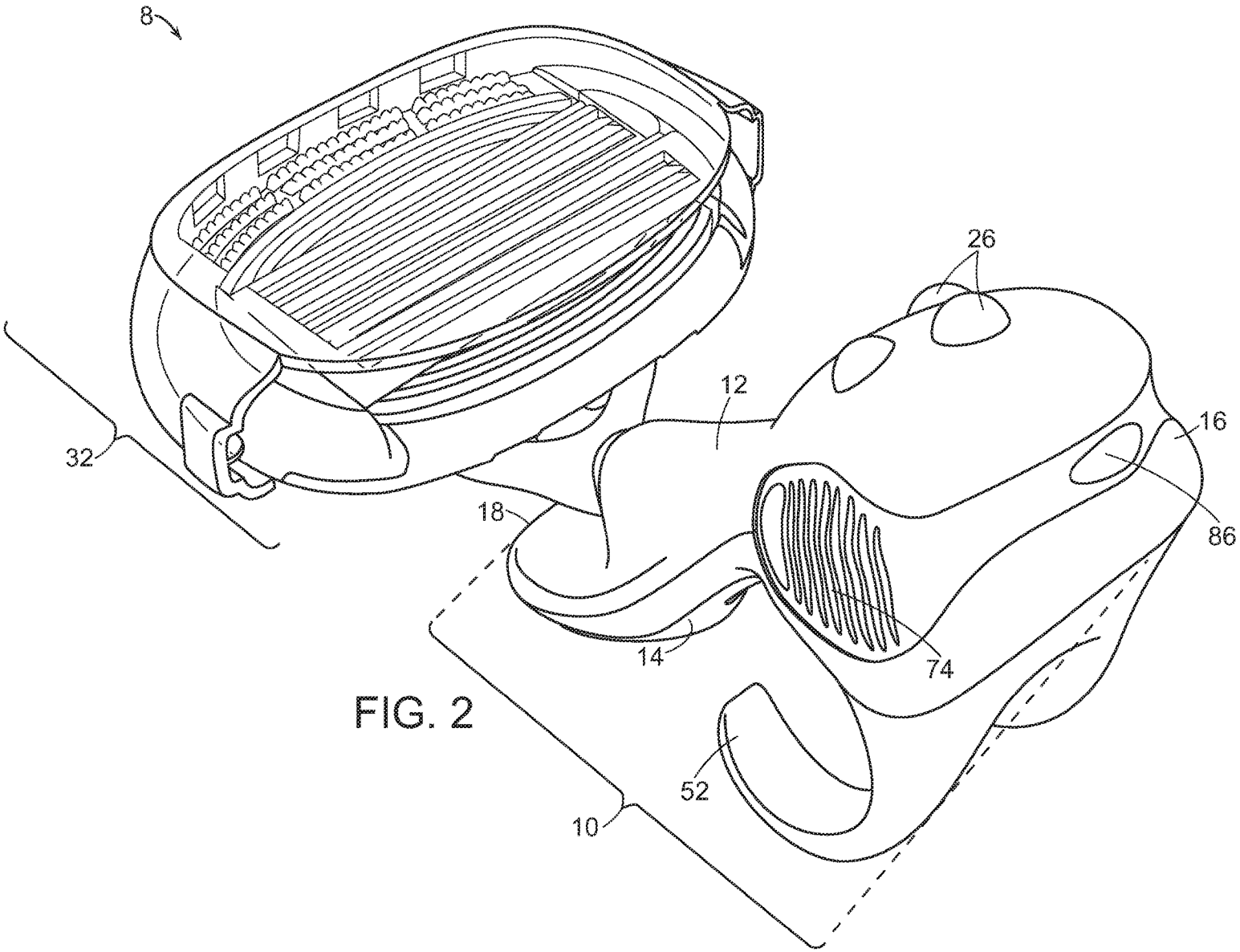
FIG. 2 illustrates a bottom perspective of view a shaving apparatus according to one embodiment of the invention.

Referring to FIGS. 1 and 2, the present invention relates to a compact shaving apparatus 8 having a relatively short apparatus body 10 (e.g., about 65-70 mm in length) that is also taller than most conventional shavers (e.g. about 30-40 mm in length, including a finger hook (split finger hook 52 as shown). The apparatus body 10 is comprised of a bottom surface 12, a top surface 14, a front portion 16 and a back portion 18. Within the apparatus body is a central lumen (not shown in FIGS. 1 and 2) having a central lumen opening 22 in the back portion 18 of the shaving apparatus 8. Reference to dimensions in this paragraph are intended be non-limiting. Also shown in FIGS. 1 and 2 are blade cartridge 32 and blade cartridge attachment arm 34, discussed in greater detail below.

Figure 3:
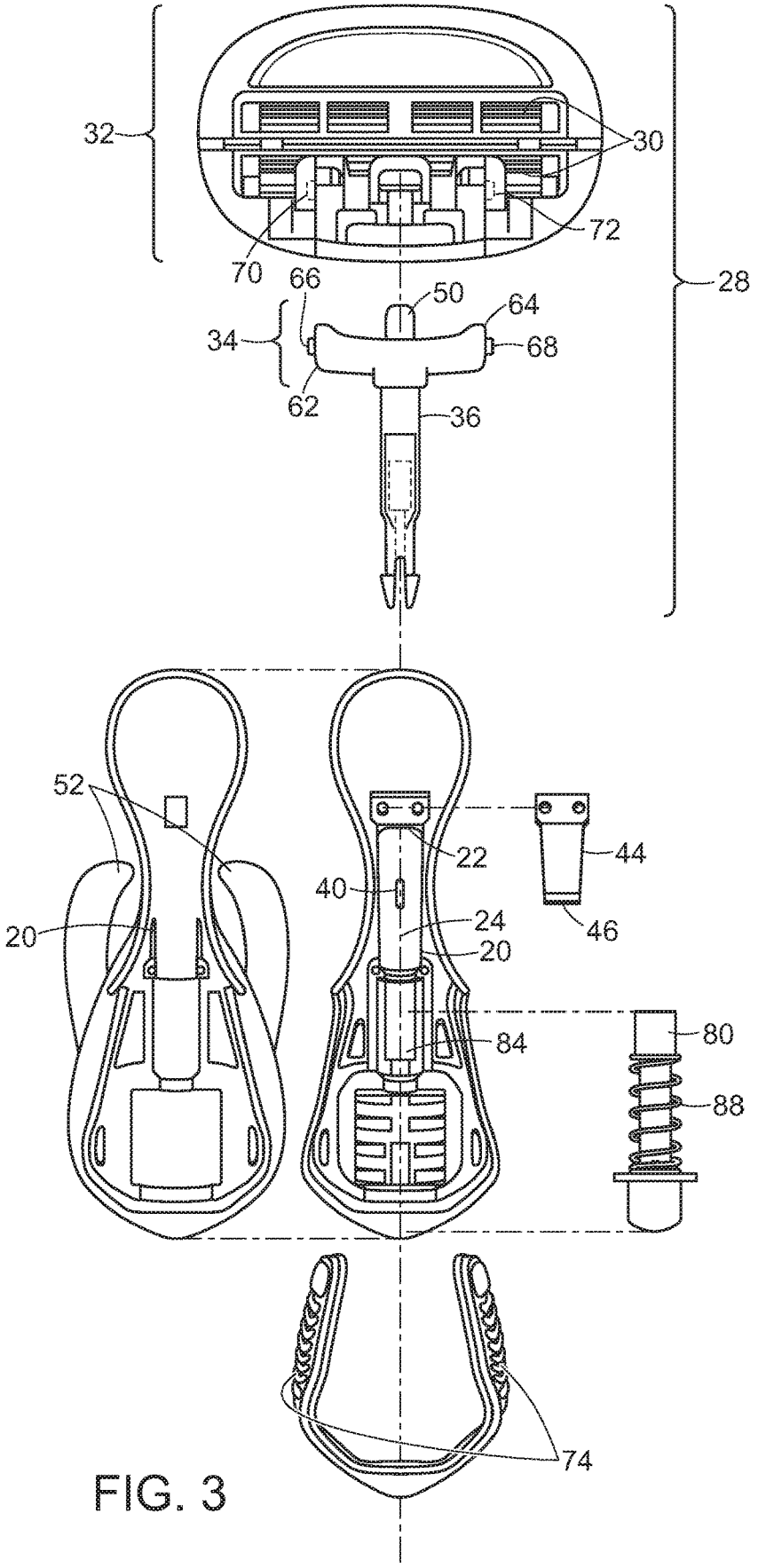
FIG. 3 illustrates an exploded view of a shaving apparatus according to one embodiment of the invention.
Figure 5:
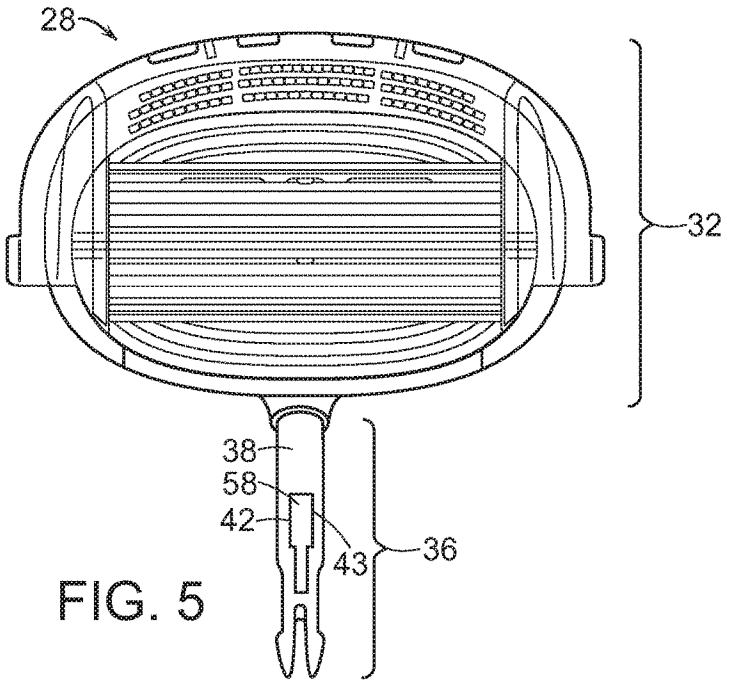
FIG. 5 illustrates a bottom perspective view of a shaving head assembly according to one embodiment of the invention.

Referring to FIG. 3, disclosed are embodiments having a fixed, or a removable shaving head assembly, with removable shaving head assembly 28 shown in FIG. 3. In preferred embodiments, the shaving head assembly 28 is comprised of a blade cartridge 32 having one or more shaving blades 30. Each of the shaving blades 30 has a major orientation axis which are parallel in embodiments having more than one shaving blade. The blade cartridge 32 attaches to a mounting shaft 36 through a blade cartridge attachment arm 34.

As will be discussed in greater detail below, in preferred embodiments, the shaving head assembly 28, or a subunit thereof, rotates about an axis of rotation defined by the major axis of the mounting shaft 36. In preferred embodiments, the mounting shaft 36 is a rotating mounting shaft. Alternatively, mounting shaft 36 may be fixed and the required rotation is provided by another element of the shaving head assembly. The exploded perspective provided in FIG. 3 reveals aspects of the shaving apparatus 8 not seen in perspective view of FIGS. 1 and 2.

One skilled in the art will recognize that various elements shown in FIG. 3 and described herein are most readily produced through a molding or injection molding process using plastics, resins or other polymeric materials. Other materials, such as metals or ceramics can be utilized alternatively.

FIG. 3 shows internal portions of central lumen 20 including central lumen bearing surface 24 and central lumen opening 22. Also shown protruding from the bearing surface of the central lumen 24 is a raised element 40 depicted as fin rising from the central lumen bearing surface 24. As discussed in greater detail below, raised element 40 cooperates with a feature on the mounting shaft bearing surface 38 to limit the freedom of rotation of mounting shaft 36. Also readily seen in FIG. 3 is a rotating embodiment of mounting shaft 36. The rotating embodiment of mounting shaft 36 depicted is also a removable embodiment which will be described in greater detail below. Not all embodiments of mounting shaft 36 are removable from central lumen 20.

The drawings included herein show an embodiment with a front portion 16 including one or more rolling element(s) 26 rotatably attached to the bottom surface 12 (see, for example, FIGS. 1 and 2). In use, embodiments shown in the attached drawings are brought into contact with a surface to be shaved (e.g., leg or torso) with two points of contact. The two points of contact with the surface to be shaved are: 1) rolling element(s) 26; and 2) blade cartridge 32.

Rolling element(s) 26 can be produced from any material including metal, plastic or other composite. As shown in FIG. 2, rolling elements 26 can protrude through a hole in the bottom surface 12 of the apparatus body 10 near the front portions 16 of the body. While rolling element(s) 26 are depicted as spheres or balls in some embodiments, wheel and wheel/axle combinations can be used in other embodiments.

In use, as the front portion 16 of the shaving apparatus 8 is advanced along the surface to be shaved, the shaving blade(s) 30 within the blade cartridge 32 cut hair shafts protruding from the surface to be shaved. In an alternative embodiment not specifically shown in the drawings, the orientation of the shaving blade(s) is reversed in the blade cartridge and the overall orientation of the shaving apparatus is reversed such that the front portion of the shaving apparatus comprises the shaving blades and the back portion of the shaving apparatus comprises the rolling elements.

In a preceding paragraph, the surface to be shaved was posited to be a flat plane. In reality, a user may be shaving highly contoured surfaces of the body and the ability of the shaving head assembly, or a subunit thereof, to rotate about an axis of rotation defined by the major axis of the mounting shaft enables shaving blade(s) 30 to maintain good cutting contact along a highly contoured surface to be shaved. As previously indicated, this ability to rotate about an axis of rotation defined by the major axis of the mounting shaft is preferably provided through the use of a rotating mounting shaft.

As best shown in FIGS. 4-7, in preferred embodiments the shaving head assembly is designed to be rotatable between a neutral position and most extreme positive and negative non-neutral positions. The neutral position is the position adopted by the shaving head assembly in the absence of external forces, and this neutral position would be the optimal position for shaving a flat planar surface. In use, as a surface to be shaved diverges from a flat planar surface, the shaft can rotate clockwise (e.g., in a positive direction) or counterclockwise (e.g., in a negative direction) to maintain good cutting contact between shaving blade(s) 30, and the surface to be shaved. In preferred embodiments, a most extreme positive and a most extreme negative rotation are defined mechanically. In preferred embodiments the most extreme positive and most extreme negative positions are less than 35 degrees of rotation in the clockwise or counterclockwise direction. In other preferred embodiments the most extreme positive and most extreme negative positions are less than 25 degrees of rotation in the clockwise or counterclockwise direction. In still other preferred embodiments the most extreme positive and most extreme negative positions are less than 10 degrees of rotation in the clockwise or counterclockwise direction.

Figure 6:
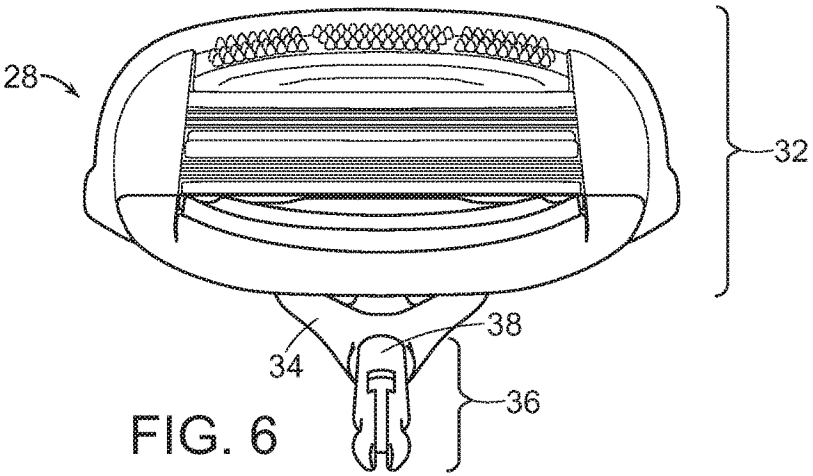
FIG. 6 illustrates an end perspective view of a shaving head assembly according to one embodiment of the invention.
Figure 4:
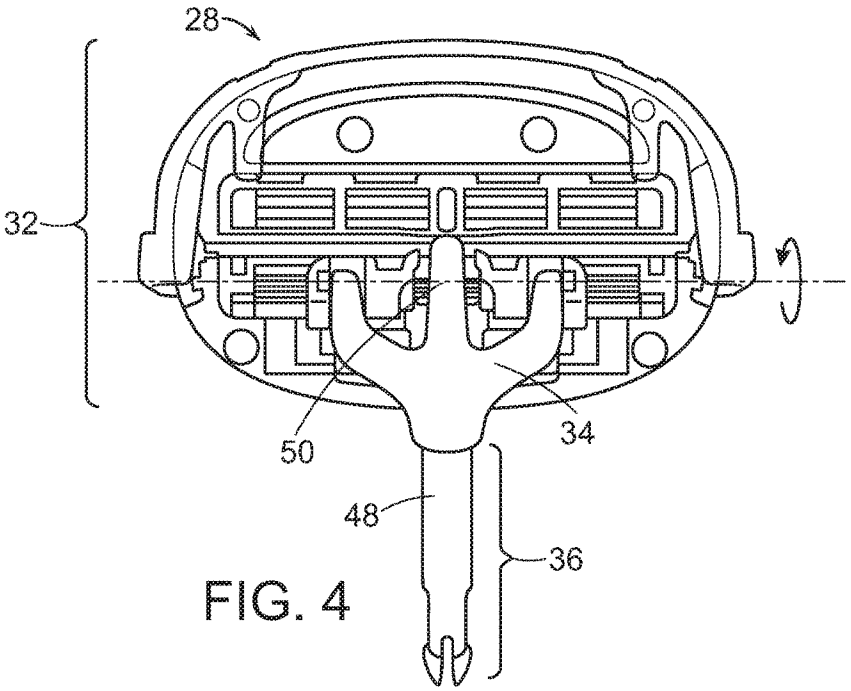
FIG. 4 illustrates a top perspective view of a shaving head assembly according to one embodiment of the invention.

As indicated, the extent of rotation of the rotating mounting shaft is defined mechanically. More specifically, the range of rotation between the neutral position and the most extreme positive and negative non-neutral positions is limited by a mechanical detent. In preferred embodiments, the mechanical detent is comprised of cooperative elements or features located on the mounting shaft bearing surface 38 and the central lumen bearing surface 24. Certain mounting shaft 36 detail is best shown in FIG. 6. For example, mounting shaft bearing surface 38, in preferred embodiments, is the surface oriented toward the blade cartridge 32. The outer diameter of mounting shaft bearing surface 38 is generally round in shape and, in use, contacts central lumen bearing surface 24 described previously. The portion of the mounting shaft 36 oriented away from the blade cartridge 32 is referred to herein as the flat portion 48 of the rotating mounting shaft. In preferred embodiments, mounting shaft bearing surface 38 includes a rectangular recess 58 comprising a first fixed mechanical barrier 42 (i.e., a first wall of the rectangular recess 58), and a second fixed mechanical barrier 43 (i.e., a second wall of the rectangular recess 58).

Figure 7C:
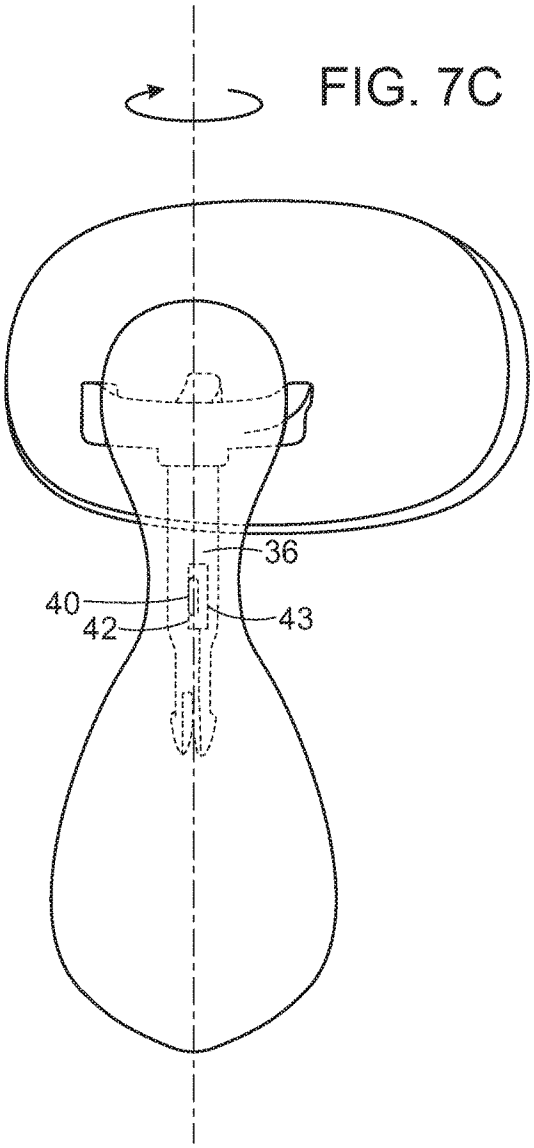
FIGS. 7A-C illustrate the action of the mechanical detent in limiting the freedom of rotation through a top schematic view of the shaving apparatus according to one embodiment of the invention.
Figure 7B:
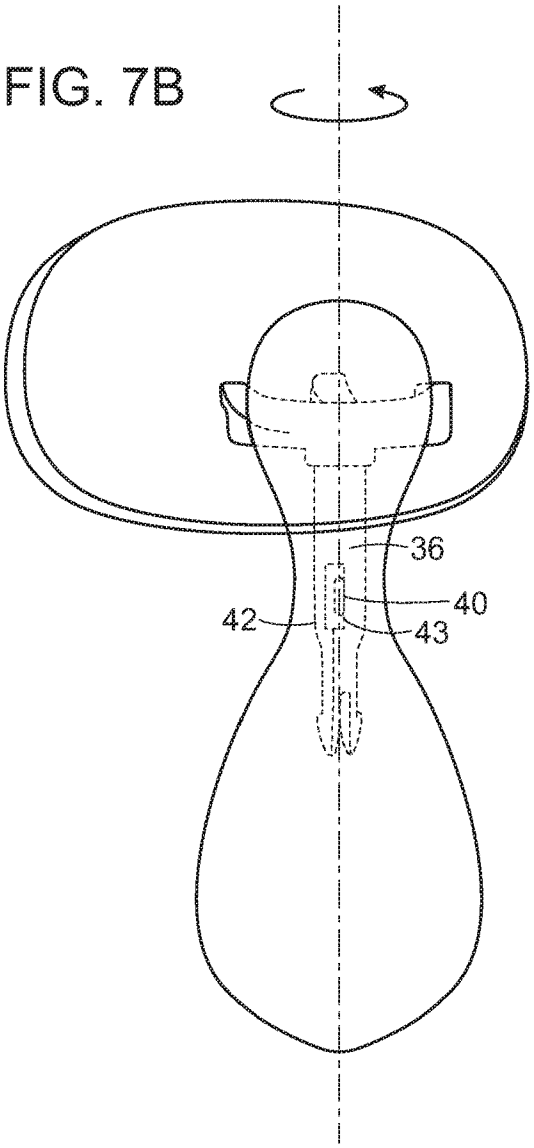
Figure 7A:
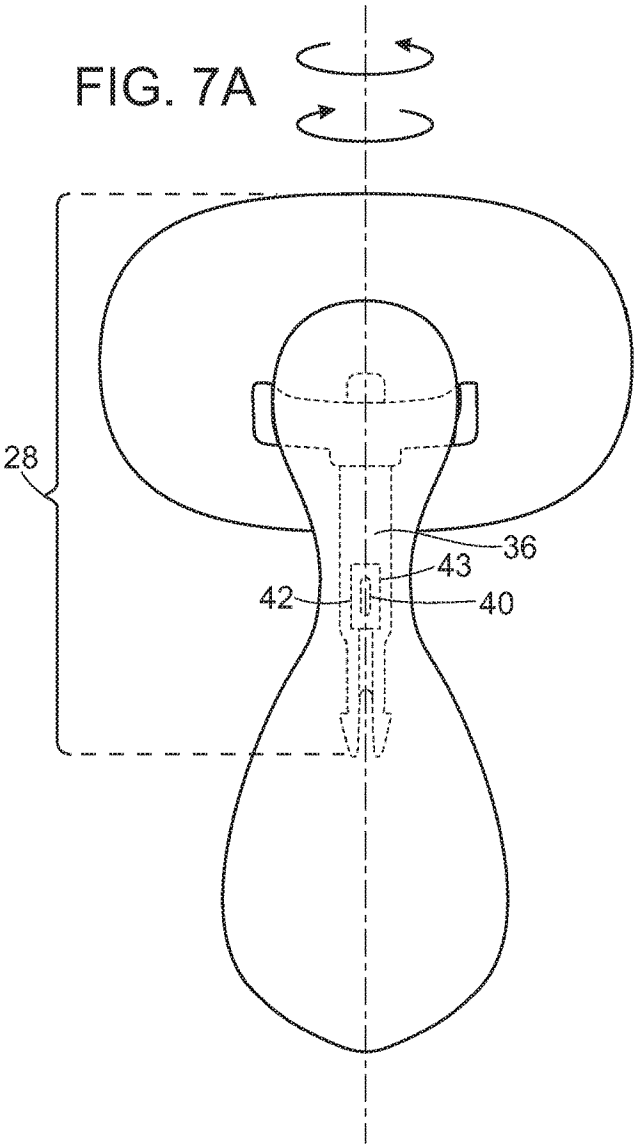

FIGS. 7A-7B depict a removable shaving head assembly 28 positioned in place within the central lumen 20. While other drawings provide additional detail, FIGS. 7A-7C are intended to illustrate the action of the mechanical detent in limiting the freedom of rotation available to mounting shaft 36. The mechanical detent comprises a raised element 40 (e.g. a fin) disposed on the central lumen bearing surface 24, which contacts a first fixed mechanical barrier 42 (e.g., a first wall of a molded rectangular recess 58) at the most extreme positive non-neutral position and a second fixed mechanical barrier 43 (e.g., a second wall of a molded rectangular recess 58) at the most extreme negative non-neutral position, thereby limiting the degree of freedom provided to the rotating mounting shaft 36. In preferred embodiments, a molded or routed hollow, such as molded rectangular recess 58) is provided on the rotating mounting shaft extending inward from mounting shaft bearing surface 38. Raised element 40 (e.g. a fin), disposed on the central lumen bearing surface, engages the molded rectangular recess. At the neutral position, the raised element is located centrally within the molded rectangular recess. At the most extreme positive non-neutral position, the raised element contacts a first wall of the molded rectangular recess 58 thereby termination the range of rotation. At the most extreme negative non-neutral position, the raised element contacts a second wall of the molded rectangular 58 recess thereby termination the range of rotation.

One skilled in the art will recognize that many alternative designs may be employed to provide the recited mechanical detent. Perhaps the simplest example is a reversal of positioning for the raised element 40 and the mechanical barriers 42 and 43. For example, the raised element 40 can be disposed on mounting shaft bearing surface 38 and the first and second mechanical barriers 42 and 43 can be disposed on the central lumen bearing surface 24.

Figures 8, 9:
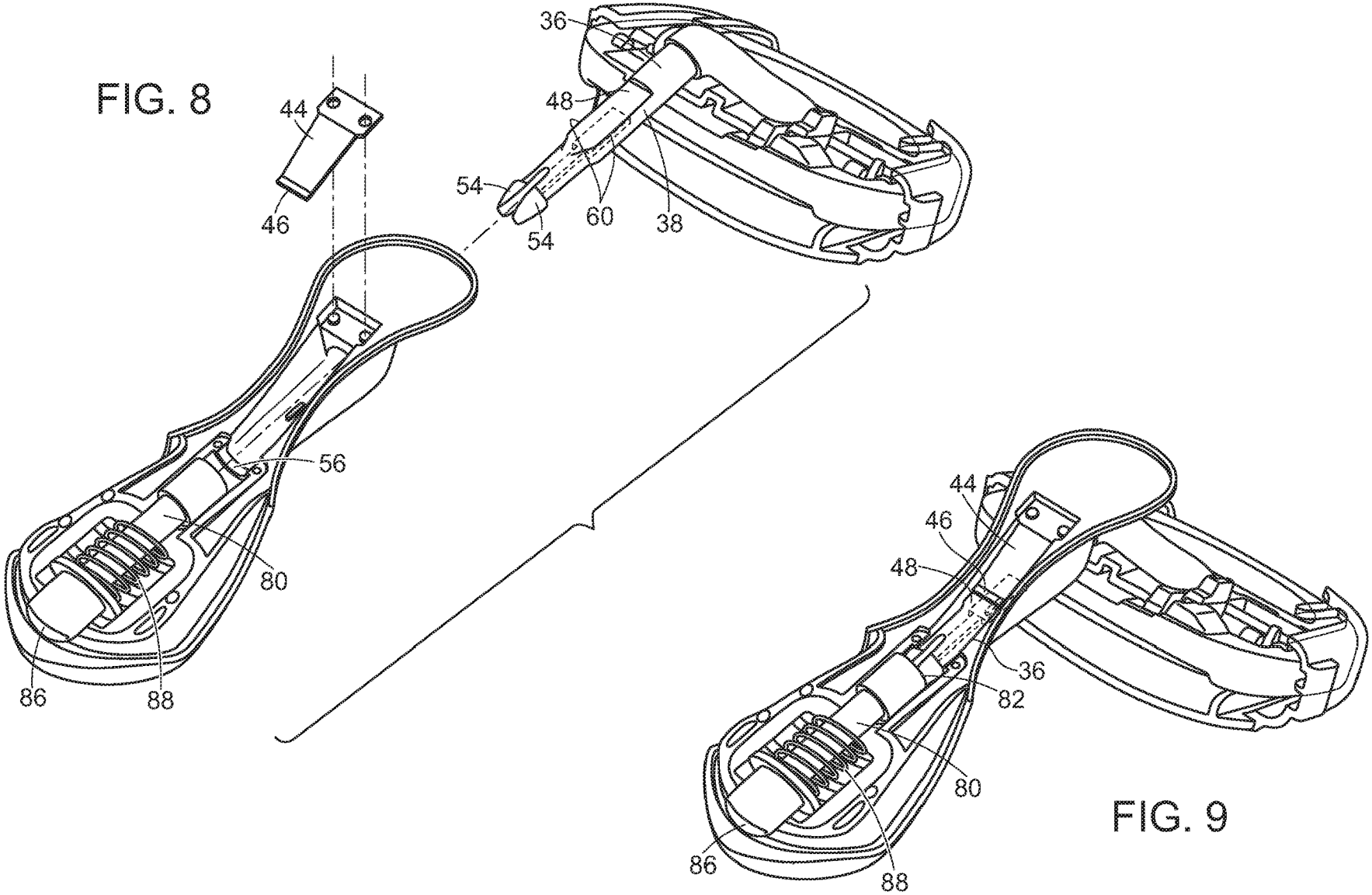
FIG. 8 illustrates a top exploded perspective view of a partially assembled shaving apparatus according to one embodiment of the invention.
FIG. 9 illustrates a top perspective view of a partially assembled shaving apparatus according to one embodiment of the invention.

As previously indicated, in preferred embodiments the shaving head assembly 28 is rotatable between a neutral position and most extreme positive and negative non-neutral positions. The neutral position is the position adopted by the shaving head assembly in the absence of external forces. As shown in FIGS. 8 and 9, rotating mounting shaft 36 is urged to neutral from any positive or negative non-neutral position through the action of a resilient pressure plate 44 on a flat portion 48 of rotating mounting shaft 36. As the rotating mounting shaft, through the action of an external force (e.g., resulting from shaving contact with a contoured shaving surface), is rotated within fixed limits in a positive or negative direction, resilient pressure plate 44 exerts force on a longitudinal edge 60 of the rotating mounting shaft 36 at the intersection of the mounting shaft bearing surface 38 and the flat portion of the mounting shaft 48. Upon removal of the external force (e.g., by lifting the razor out of contact with the shaving surface), the force applied by the pressure plate contact point 46 (which is generally flat) on a longitudinal edge 60 of the rotating mounting shaft 36 tends to rotate the mounting shaft 36 back to the neutral position where the generally flat pressure plate contact point 46 makes contact with the flat portion of the rotating mounting shaft 48. Essentially, this result is dictated by the minimum potential energy principle which dictates that a structure shall displace to a position that minimizes the total potential energy.

Referring again to FIGS. 3 and 4, in addition to rotation about an axis of rotation defined by the major axis of the mounting shaft 36, in preferred embodiments the blade cartridge 32 is rotatable about an axis generally parallel to the major orientation axis of the one or more shaving blade(s) 30. In preferred embodiments, this axis of rotation is defined by connection between the blade cartridge 32 and the blade cartridge attachment arm 34.

Referring to FIG. 3, for example, elements of a snap joint from a preferred embodiment are shown for connection of the blade cartridge 32 to the blade cartridge attachment arm 34. Snap joints represent a simple and economical means to connect two components, and snap joints are particularly well suited to use in connection with molded (e.g., injection molded) components. All snap joints are characterized by the presence of a protruding part of a first component (e.g., a hook, stud or bead) that is deflected briefly during the joining process and catches in a depression or other feature in the second component. Referring to the preferred embodiment depicted in FIG. 3, blade cartridge attachment arm 34 has two blade cartridge attachment fingers 62 and 64. Each of the two attachment fingers 62 and 64, are provided with a first and second snap joint stud 66 and 68 which are outwardly facing on the depicted embodiment. When snapped into position, the studs 66 and 68 engage shaped snap joint depressions 70 and 72 in the blade cartridge. Therefore, with respect to the preferred embodiment depicted in FIG. 3, this axis of rotation is defined by the snap fit connections between studs 66 and 68 and shaped depressions 70 and 72.

One skilled in the art will recognize alternatives to snap fit connection between the blade cartridge 32 and blade cartridge attachment arm 34. For example, dimensional bores can be introduced in the components to be joined and a dimensional rod can be fitted through the dimensional bores in an axle-like manner to enable rotation of one part relative to another.

In preferred embodiments, the blade cartridge 32 rotates about an axis generally parallel to the major orientation axis of the one or more shaving blade(s) 30 between a neutral position and range of non-neutral positions, terminating at the most extreme non-neutral position. In preferred embodiments, the range of rotation between the neutral position and the most extreme non-neutral position is less than 60 degrees. In another preferred embodiment, the range of rotation between the neutral position and the most extreme non-neutral position is less than 45 degrees. In yet another preferred embodiment, the range of rotation between the neutral position and the most extreme non-neutral position is less than 30 degrees.

Again referring to FIGS. 3 and 4, a resilient limiting finger 50 on blade cartridge attachment arm 34 engages blade cartridge 32. Absent external forces, through the action of the minimum potential energy principle, the resilient limiting finger 50 tends to urge the blade cartridge to the neutral position. As external forces are encountered, for example, through the shaving process, the blade cartridge is free to rotate through a range of non-neutral positions terminating at the most extreme non-neutral position. The most extreme non-neutral position can be defined through contact with a mechanical barrier or through the action of the limiting finger 50. This rotational ability about an axis generally parallel to the major orientation axis of the one or more shaving blade(s) also tends to maintain good cutting contact between shaving blade(s) 30 and the surface to be shaved when contours are encountered.

Figure 11:
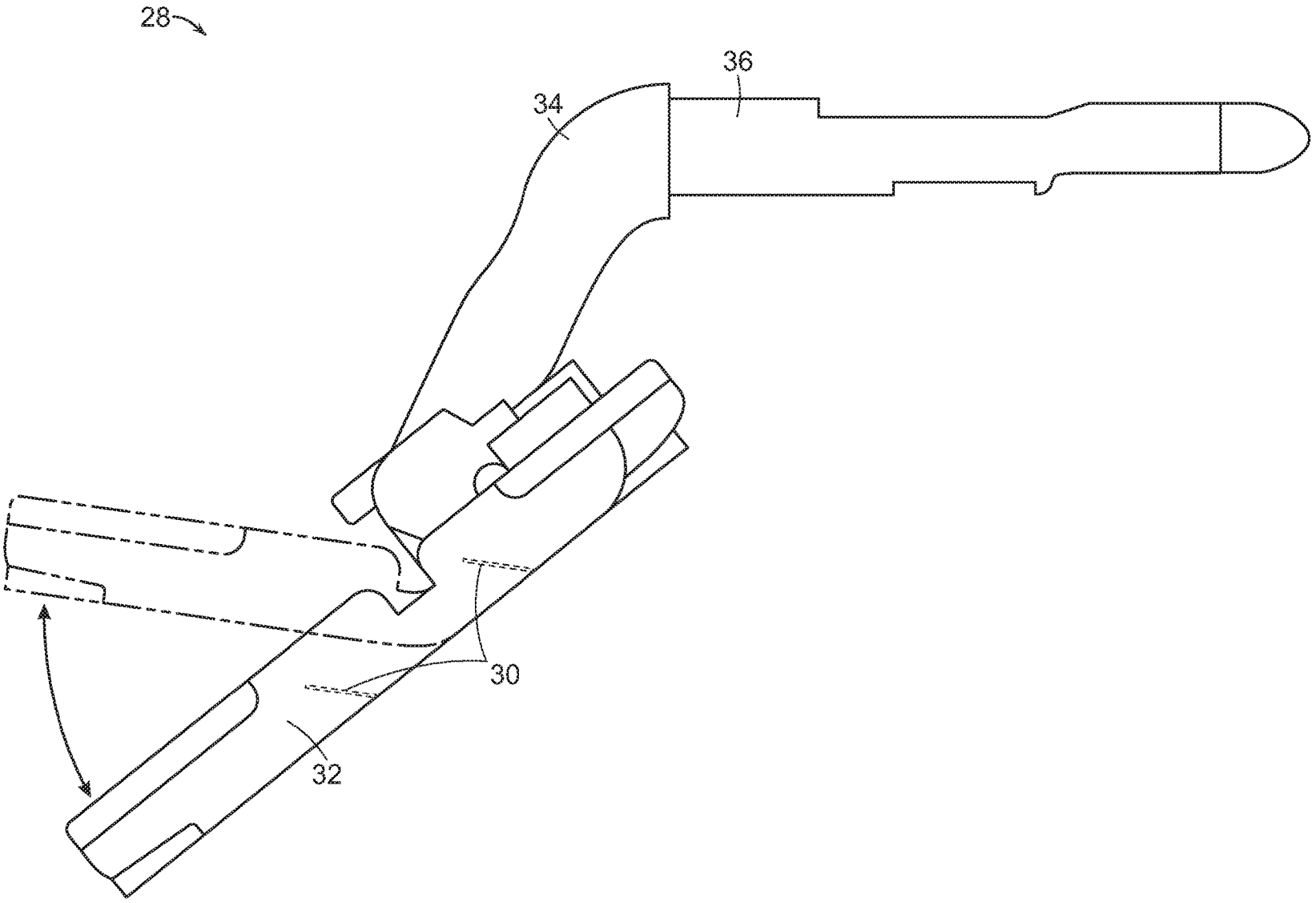
FIG. 11 illustrates a side view of a shaving head assembly according to one embodiment of the invention.

In preferred embodiments as shown, for example, in FIG. 11 a plurality of shaving blades 30 are mounted within blade cartridge 32 and blade cartridge 32 is flexible about an axis generally parallel to the major orientation axis of the plurality of blades and wherein the axis of flexibility is between at least two shaving blades 30. The introduction of a flexible hinge is well known in the art.

Figure 10:
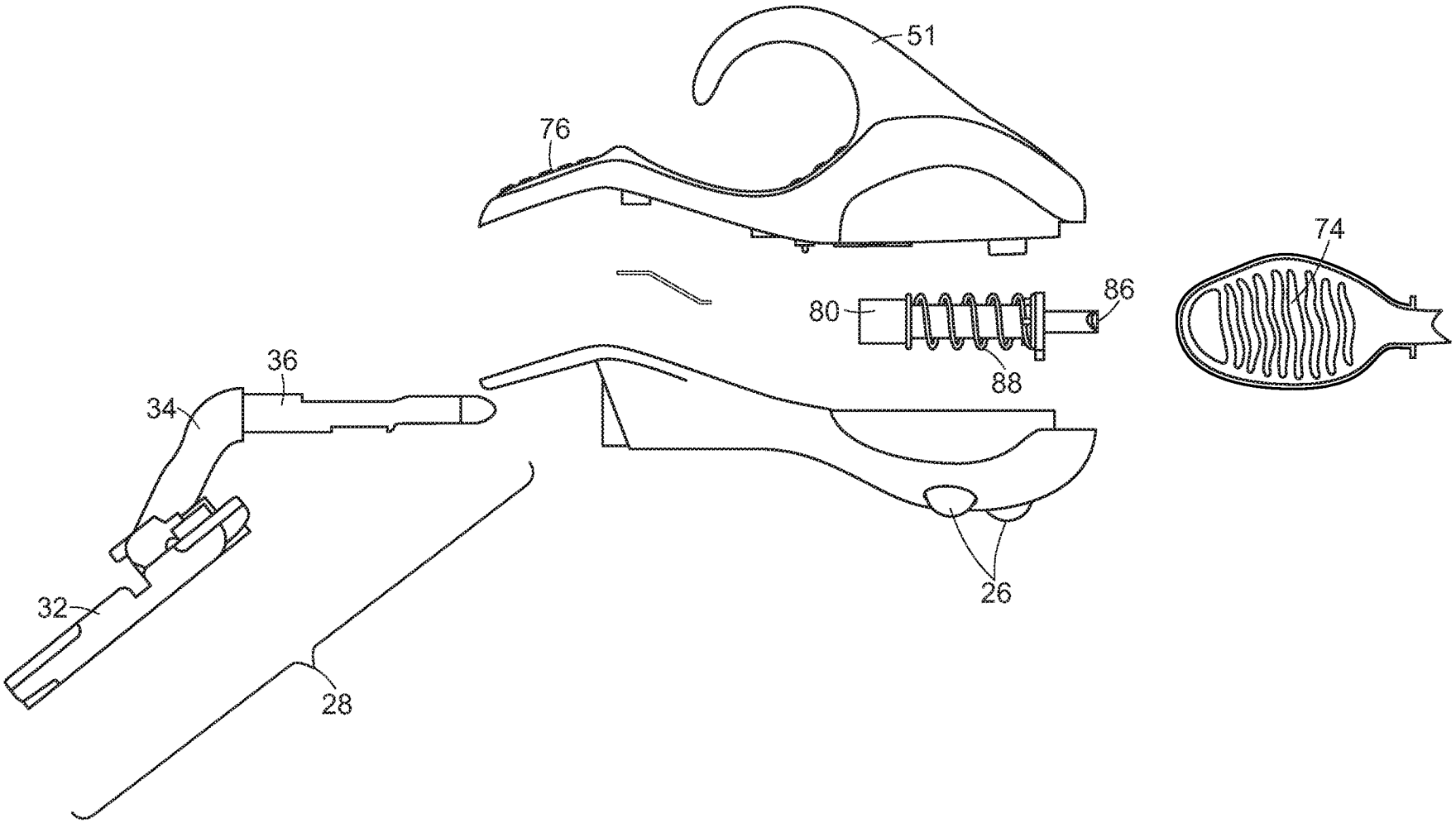
FIG. 10 illustrates a side exploded view of a shaving apparatus according to one embodiment of the invention.

Other features of the shaver include a finger hook 51 (FIG. 10) or split finger hook 52 (FIGS. 1-3). The finger hook (split or non-split) enables a user to insert a finger through the finger hook in a direction generally perpendicular to the direction of shaving. This provides a comfortable and secure connection between the user and the razor. Other features in preferred embodiments include thumb and finger grips 74 (FIGS. 1-3 and 10) on the apparatus body. As an additional feature of the preferred split finger embodiment, the split finger hook is sized to accommodate a human finger running along the length of the upper surface of the body when in use. At least one finger pad 76 (FIGS. 1-2 and 10) is also provided on the top surface 14 of the device in preferred embodiments.

As previously indicated, the rotating mounting shaft 36 depicted in FIG. 3, for example, is removable from the central lumen 20 enabling replace of the shaving head assembly 28 as shaving blade(s) 30 become worn and dull. Referring to FIGS. 8 and 9, a snap fit connection is utilized in the preferred embodiment depicted. In particular, the distal terminus of the removable mounting shaft 36 is provided with snap fit engagement elements 54 which engage retaining elements 56 (e.g., a shoulder) defining a feature within central lumen 20. The snap fit element at the proximal end of the mounting shaft 36 is comprised of a split hook in the preferred embodiment depicted. As the split hook engages a dimensional engagement orifice 78 of the central lumen 20, the split hook is deflected briefly, and snaps back to engage a shoulder of the engagement orifice 78 as the split hook passes through the dimensional engagement orifice 78. To disengage an engaged removable mounting shaft 36, an actuator 80 is provided to mechanically deflect snap fit engagement elements 54 such that the split hook engagement elements 54 no longer engage the shoulder of engagement orifice 78 thereby enabling release of the mounting shaft 36 and the entire shaving head assembly 28.

In the embodiment depicted in FIG. 3, the actuator 80 acts longitudinally on the engagement elements 54 reducing their occupied diameter to a value less than the diameter of engagement orifice 78. As can be seen, in preferred embodiments engagement elements 54 are ramped and the ramped portions engage an annular recess 82 at the distal end of actuator 80. As the actuator is displaced longitudinally in the direction of the engagement elements 54, through force applied at the proximal end 86 (best seen in FIGS. 2 and 8-9) of actuator 80 contact of the ramped portion of the split hook 79 engagement elements 54 deflects the split hooks and disengages the removable mounting shaft 36 from the engagement orifice 78.

In preferred embodiments, inner portions of the body 10 of the shaving apparatus 8 are provided with an actuator housing 84 (best shown in FIG. 3). In preferred embodiments, the actuator 80 is paired with a return spring 88 (see FIGS. 3 and 8-10) to return the actuator to a disengaged position enabling insertion of a shaving head assembly 28. As an alternative to the longitudinal actuator 80 depicted in the drawings, one skilled in the art will recognize that a transverse actuator could be implement through the use of no more than routine experimentation.

The above description of the disclosed embodiments is provided to enable a person skilled in the art to make and use the invention. Various modifications to these embodiments will be readily apparent to one of skill in the art, and the general principles described herein can be applied to other embodiments without departing from scope of the invention. Thus it is to be understood that the description and drawings presented herein represent presently preferred embodiments of the invention and therefore are representative of the subject matter which is broadly contemplated by the present invention. It is further understood that the scope of the present invention may encompass other embodiments developed by one skilled in the art through the use of no more that routine experimentation.

The invention claimed is:

1. A shaving apparatus, comprising:

a body comprising:

a bottom surface, a top surface, a front portion, a back portion and a central lumen forming a lumen opening at the back portion of the apparatus, the central lumen having a bearing surface;

one or more rolling elements rotatingly attached to the bottom surface, near the front portion of the apparatus;

a shaving head assembly rotatably attachable within the central lumen of the body, the shaving head assembly comprising:

one or more shaving blades mounted within a blade cartridge, the one or more shaving blades having a major orientation axis;

a blade cartridge attachment arm for attachment of the blade cartridge to a mounting shaft having a bearing surface;

wherein the shaving head assembly, or a subunit thereof, rotates about an axis of rotation defined by the major axis of the mounting shaft;

wherein the shaving head assembly is removably retained within the central lumen through the cooperation of one or more engagement elements of the mounting shaft with retaining elements located within the central lumen; and wherein the removal of the shaving head assembly is facilitated through a mechanical release mechanism which includes an actuator having a proximal end, wherein when a force is applied at the proximal end of the actuator, the actuator is displaced to interrupt the cooperative engagement between the one or more engagement elements of the mounting shaft with the retaining elements located within the central lumen.

2. The shaving apparatus of claim 1 wherein the mounting shaft is a rotating mounting shaft.

3. The shaving apparatus of claim 1 wherein the one or more shaving blades includes a plurality of shaving blades mounted within the blade cartridge and the blade cartridge is flexible about an axis generally parallel to the major orientation axis of the plurality of blades.

4. The shaving apparatus of claim 1 wherein the shaving head assembly is rotatable between a neutral position and most extreme positive and most extreme negative non-neutral positions.

5. The shaving apparatus of claim 4 wherein the range of rotation between the neutral position and the most extreme positive and negative non-neutral positions is less than 35 degrees in either direction.

6. The shaving apparatus of claim 4 wherein the range of rotation between the neutral position and the most extreme positive and negative non-neutral positions is less than 25 degrees in either direction.

7. The shaving apparatus of claim 4 wherein the range of rotation between the neutral position and the most extreme positive and negative non-neutral positions is less than 10 degrees in either direction.

8. The shaving apparatus of claim 4 wherein the range of rotation between the neutral and the most extreme positive and negative non-neutral position is limited by a mechanical detent.

9. The shaving apparatus of claim 8 wherein the mechanical detent comprises a raised element disposed on the bearing surface of the central lumen which engages a first fixed mechanical barrier on the rotating mounting shaft at the most extreme positive non-neutral position and engages a second fixed mechanical barrier at the most extreme negative non-neutral position.

10. The shaving apparatus of claim 9 wherein the raised element comprises a fin and the first and second mechanical barriers comprise walls extending inward from the bearing surface of the rotating mounting shaft.

11. The shaving apparatus of claim 8 wherein the mechanical detent comprises a raised element disposed on the bearing surface of the rotating mounting shaft which engages a first fixed mechanical barrier on the central lumen at the most extreme positive non-neutral position and engages a second fixed mechanical barrier on the central lumen at the most extreme negative non-neutral position.

12. The shaving apparatus of claim 11 wherein the raised element comprises a fin and the first and second mechanical barriers comprise walls extending outward from the bearing surface of the central lumen.

13. The shaving apparatus of claim 1 wherein the rotating mounting shaft is, absent external forces, urged to neutral from any positive or negative non-neutral position through the action of a resilient pressure plate having a generally flat point of contact, with a generally flat portion of the rotating mounting shaft.

14. The shaving apparatus of claim 1 wherein the blade cartridge is rotatable about an axis generally parallel to the major orientation axis of the one or more shaving blades.

15. The shaving apparatus of claim 14 wherein axis of rotation is defined by the connection between the blade cartridge and the blade cartridge attachment arm.

16. The shaving apparatus of claim 15 wherein the blade cartridge rotates between a neutral position and a range of non-neutral positions, the range of rotation terminating at the most extreme non-neutral positon.

17. The shaving apparatus of claim 16 wherein the range of rotation between the neutral position and the most extreme non-neutral position is less than 60 degrees.

18. The shaving apparatus of claim 16 wherein the range of rotation between the neutral position and the most extreme non-neutral position is less than 45 degrees.

19. The shaving apparatus of claim 16 wherein the range of rotation between the neutral position and the most extreme non-neutral position is less than 30 degrees.

20. The shaving apparatus of claim 16 wherein the range of rotation between the neutral and the most extreme non-neutral position is limited by a resilient limiting finger on the blade cartridge attachment arm.

21. The shaving apparatus of claim 20 wherein the resilient limiting finger tends to return the shaving head to the neutral position absent external forces.

22. The shaving apparatus of claim 1 wherein the body further comprises a finger hook on the top surface.

23. The shaving apparatus of claim 22 wherein the finger hook is a split finger hook sized to accommodate a human finger running along the length of the upper surface of the body when in use.

24. The shaving apparatus of claim 1 wherein the one or more rolling elements include sphere-shaped elements.

25. The shaving apparatus of claim 1 wherein the one or more rolling elements include wheel-shaped elements.

* * * * *